US009850624B2

(12) United States Patent
Schrunk, III

(10) Patent No.: US 9,850,624 B2
(45) Date of Patent: Dec. 26, 2017

(54) MOBILE AUTOMATED TIE REPLACEMENT SYSTEM

(71) Applicant: Harsco Technologies LLC, Fairmont, MN (US)

(72) Inventor: Robert R. Schrunk, III, Truman, MN (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 350 days.

(21) Appl. No.: 14/692,243

(22) Filed: Apr. 21, 2015

(65) Prior Publication Data

US 2016/0312412 A1 Oct. 27, 2016

(51) Int. Cl.
*E01B 29/10* (2006.01)

(52) U.S. Cl.
CPC ..... *E01B 29/10* (2013.01)

(58) Field of Classification Search
CPC ..... E01B 29/10; E01B 29/24; E01B 29/29; E01B 29/32
See application file for complete search history.

(56) References Cited

U.S. PATENT DOCUMENTS 1,089,306 A 3/1914 Bell
1,431,710 A 10/1922 Uno
1,466,851 A 9/1923 Owen
1,482,981 A 2/1924 Fish
1,488,040 A 3/1924 Galland
1,613,037 A 1/1927 Kniffen
1,732,568 A 10/1929 Robb
1,822,409 A 9/1931 Lawrence
1,836,082 A 12/1931 McManus
1,985,768 A 12/1934 Drake
2,097,430 A 11/1937 Brown
2,133,851 A 10/1938 Denton
2,283,929 A 5/1942 Hughes
2,339,399 A 1/1944 Henricks
2,735,375 A 2/1956 Hesemann
2,786,426 A 3/1957 Brosnan
2,828,699 A 4/1958 Fox
2,908,228 A 10/1959 Kershaw
2,923,253 A 2/1960 Geier
3,105,674 A 10/1963 Stewart
3,106,114 A 10/1963 Cogan
3,144,833 A 8/1964 Christoff
3,240,162 A 3/1966 Foxx
3,306,232 A 2/1967 Holley
3,314,374 A 4/1967 Moorehead, Jr.
(Continued)

*Primary Examiner* — Zachary L Kuhfuss
(74) *Attorney, Agent, or Firm* — Baker & McKenzie LLP

(57) ABSTRACT

A device and method for the replacement of railroad ties is disclosed. The tie extends laterally under two rails and is attached to the rails via tie plates. An example rail changing machine includes a tie changing boom moveable to one side of the two rails. The tie changing boom including a gripping assembly for clamping the railroad tie. The tie changing boom is moveable between a proximate position and a distal position from the one side of the two rails to grip the tie and remove the tie from under the rails. A kicker is located on the opposite side of the rails from the tie changing boom and contacts one end of the tie to move the tie toward the tie changing boom. A pair of tie plate clamps to hold the tie plates in place when the kicker moves the tie.

17 Claims, 7 Drawing Sheets

(56) References Cited

U.S. PATENT DOCUMENTS

| | | | | |
|---|---|---|---|---|
| 3,496,883 | A | | 2/1970 | Bodine |
| 3,537,400 | A | | 11/1970 | Taylor |
| 3,675,580 | A | | 7/1972 | Kershaw |
| 3,691,957 | A | | 9/1972 | Plasser |
| 3,698,324 | A | | 10/1972 | Peppin |
| 3,780,664 | A | | 12/1973 | Holley |
| 3,881,422 | A | | 5/1975 | Bryan, Jr. |
| 3,948,185 | A | | 4/1976 | Settle |
| 3,964,397 | A | | 6/1976 | Dieringer et al. |
| 4,018,165 | A | | 4/1977 | Bryan, Jr. |
| 4,127,070 | A | | 11/1978 | Dieringer |
| 4,133,266 | A | | 1/1979 | Taylor |
| 4,253,398 | A | | 3/1981 | Theurer |
| 4,392,433 | A | | 7/1983 | Nyland |
| 4,418,625 | A | | 12/1983 | Allmer |
| 4,421,034 | A | | 12/1983 | Allmer |
| 4,464,995 | A | | 8/1984 | Nameny |
| 4,579,060 | A | | 4/1986 | Nameny |
| 4,770,103 | A | | 9/1988 | Allmer |
| 4,794,861 | A | | 1/1989 | Theurer |
| 4,809,614 | A | | 3/1989 | Theurer |
| 4,862,806 | A | | 9/1989 | Theurer |
| 4,872,646 | A | | 10/1989 | Siano |
| 4,884,509 | A | | 12/1989 | Theurer |
| 4,951,573 | A | | 8/1990 | Madison |
| 4,955,301 | A | | 9/1990 | Theurer |
| 4,955,302 | A | | 9/1990 | Theurer |
| 5,025,733 | A | | 6/1991 | Pierobon |
| 5,048,424 | A | | 9/1991 | Madison |
| 5,063,856 | A | | 11/1991 | Theurer |
| 5,119,723 | A | | 6/1992 | Lovitt, Jr. |
| 5,156,639 | A | * | 10/1992 | Bostrom ..... B60F 1/005 105/72.2 |
| 5,197,389 | A | | 3/1993 | Glomski |
| 5,305,692 | A | | 4/1994 | Madison |
| 5,617,795 | A | | 4/1997 | Glomski |
| 5,651,317 | A | | 7/1997 | Kim |
| 5,722,325 | A | | 3/1998 | Glomski |
| 6,158,353 | A | | 12/2000 | Theurer |
| 6,755,135 | B2 | | 6/2004 | Johnsen |

* cited by examiner

MOBILE AUTOMATED TIE REPLACEMENT SYSTEM

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present invention relates generally to railroad maintenance equipment, and, more particularly, to equipment for changing ties of a railroad.

BACKGROUND

As is well known, railroads are based on trains running on parallel metal rails. The rail road includes flat-bottom steel rails supported on timber crossties that are perpendicular to the rails. The ties are laid on crushed stone ballast. Each rail is placed on a tie plate disposed between the crosstie and the rail. The rail is held down to the crosstie with spikes that are driven through the tie plate to the crosstie. Additional tie anchors may be used to join the rail to the crosstie. The crosstie transfers the loads from the rails to the ballast and the ground underneath and holds the rails to the correct gauge. Typically, crossties are timber treated with creosote, copper-chrome-arsenic, or other wood preservative. The purpose of the ballast is to support the ties and allow some adjustment of their position, while allowing free drainage.

Railroads require periodic maintenance and replacement of worn out components such as crossties. For example, the crossties must be periodically inspected and replaced to maintain the rail gauge as well as insure the track transfers load. Replacement of crossties therefore must be performed quickly with a minimal amount of disturbance to the rails.

Currently, replacement of ties involves a tie gang that is a long series of machines that together march along the track, replacing bad crossties with new ones. From front to back, a tie gang includes machine operators to operate a sequence of machines such as spike pullers, spike reclaimers, tie cranes, tie extractor(s), anchor spreaders, tie cranes, tie inserters, tampers, plate placers, spike drivers, and surfacing machines to tamp the track and groom the ballast. There are also numerous workers on foot, handling tie plates and dealing with anomalies that come up where the machines have trouble. Old ties are marked with paint ahead of a tie gang, so the workers know which ties are to be replaced. New ties are typically distributed in bunches by another set of machines. Typically, this is done with a standard excavator running on top of a series of gondolas to bring the bunches of new ties near the rails. Near the front of the tie gang, a tie crane is used to distribute the bunches of ties so that a new tie is positioned next to each old tie that is to be replaced.

Currently, a "conventional" tie changing machine is used that operates by extracting ties with a mechanical arm while the rails are lifted above the tie to be pulled out. An example of a conventional tie changing machine is the TR-10 Tie Exchanger manufactured by Harsco Rail of Columbia, S.C. In order for the TR-10 to function, the spikes or clips must first be removed from the tie that is to be replaced. The conventional tie changing machine such as the TR-10 discards the tie plates and therefore requires a worker to manually pick up the tie plates and reposition them before the new ties may be inserted.

Following the tie removal, other, separate machines are used to spread the anchors and carefully position a new tie in line with the open crib. Additional conventional tie changing machines such as the TR-10 are used to insert the new ties. The inserters are followed by a tamping machine, additional laborers who reposition the tie plates on the new tie, and finally a plate inserter/rail lifter that slides the tie plates into their final position.

Thus, there is a need for a combined tie changing machine that can simultaneously hold the tie plates, spread the anchors, pull out the old tie, and insert a new tie, to save labor and machine costs. There is a further need for a tie changing machine having a similar construction as to existing excavators in order to facilitate the tie changing operation. There is a further need for a tie changing machine that is self-propelled and may remove ties from either side of a set of rails.

SUMMARY

According to one example, a railroad tie changing machine for replacing a railroad tie is disclosed. The railroad tie extends laterally under two rails and is attached to the two rails via tie plates. The tie changing machine includes a tie changing boom moveable to one side of the two rails. The tie changing boom includes a gripping assembly for clamping the railroad tie. The tie changing boom is moveable between a proximate position and a distal position from the one side of the two rails to grip the tie and remove it from under the two rails. The tie changing machine includes a kicker located on the opposite side of the rails from the tie changing boom. The kicker is moveable to contact one end of the tie to move the tie toward the tie changing boom. The tie changing machine includes a pair of track jacks to raise the tracks at a location proximate to the tie. The tie changing machine includes a pair of tie plate clamps to hold the tie plates in place when the kicker moves the tie.

Another example is a method of replacing an old railroad tie mounted under two rails via tie plates using a tie changing machine including a tie gripper assembly, a tie plate clamp assembly, and a kicker assembly. The tie plates are clamped in place over the old railroad tie with the tie plate clamping assembly. The rails are jacked up. The tie gripper assembly is moved in proximity to one end of the old railroad tie via a boom arm from one lateral end of the track. The opposite end of the old railroad tie is pushed via a kicker assembly. One end of the old railroad tie is gripped via the gripper assembly. The boom assembly is moved to remove the old railroad tie from under the rails. One end of a new railroad tie is gripped via the gripper assembly. The boom assembly is moved to insert the new railroad tie in position under the rails.

Additional aspects of the invention will be apparent to those of ordinary skill in the art in view of the detailed description of various embodiments, which is made with reference to the drawings, a brief description of which is provided below.

Figure 1A:
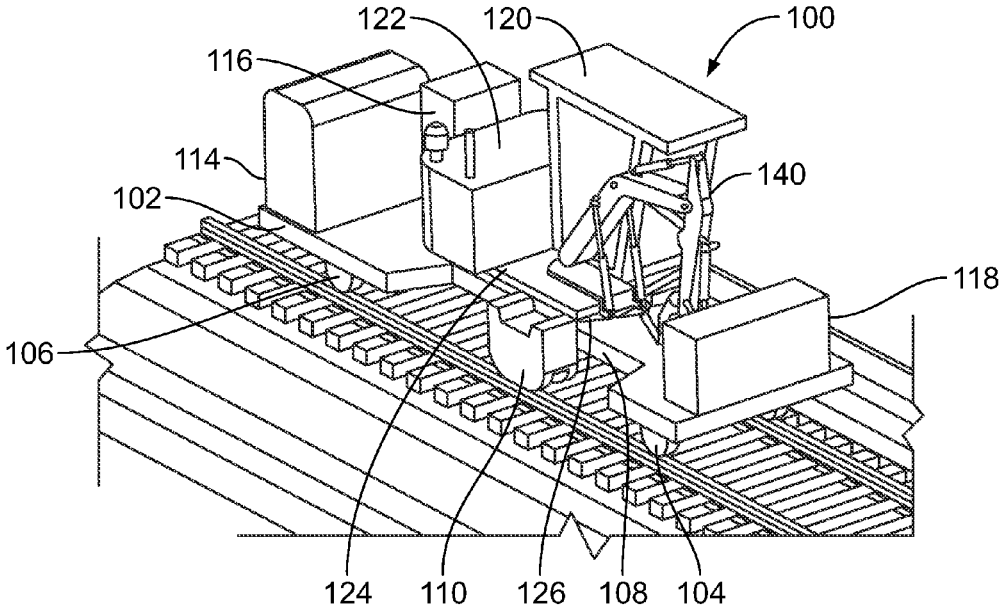
FIG. 1A is a perspective view of an example self-propelled tie changing machine.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

Figure 1B:
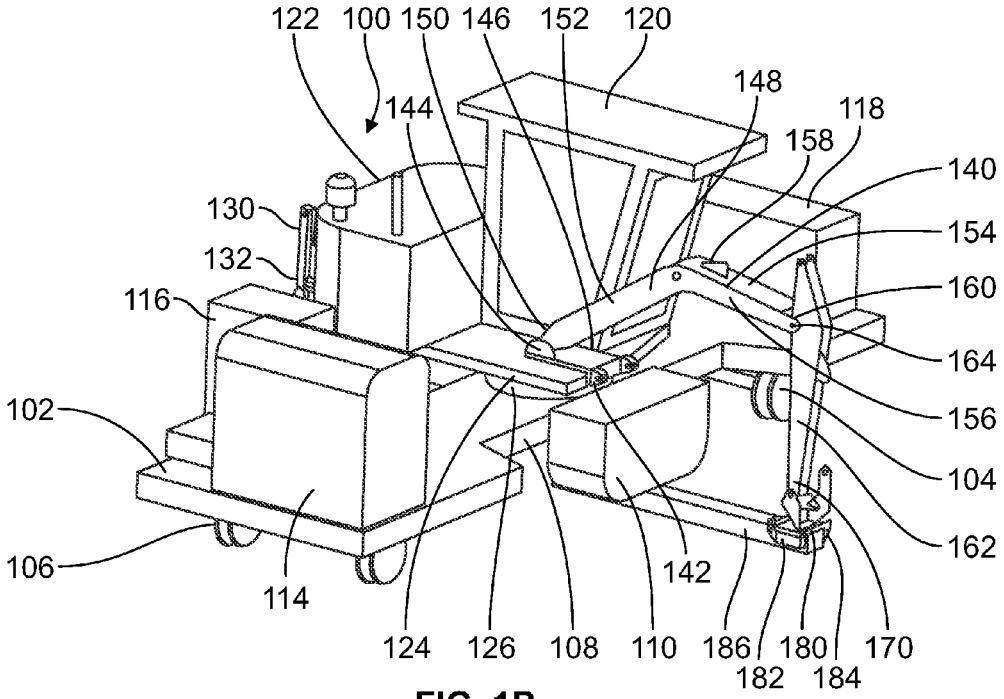
FIG. 1B is a perspective view of the self-propelled tie changing machine in FIG. 1A gripping a railroad tie.
Figure 1C:
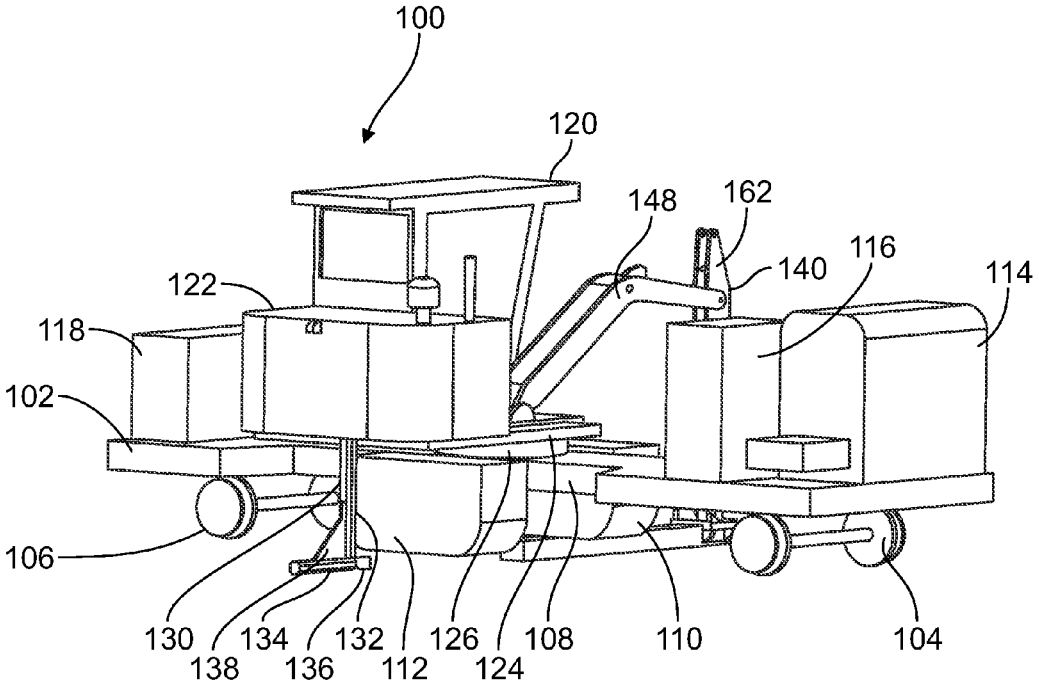
FIG. 1C is a perspective, opposite side view of the tie changing machine in FIG. 1A gripping a railroad tie.

FIG. 1A-1C show perspective views of a self-propelled tie changing machine 100. The tie changing machine 100 includes a railway chassis 102 that is mounted on sets of wheels 104 and 106. The tie changing machine 100 may therefore be moved via rail. The chassis 102 includes a pair of indentations 108. The indentations 108 each mount a rail/plate clamp assembly 110 and 112. The chassis 102 also includes a railway engine compartment 114, a hydraulic reservoir 116, and a fuel tank 118. The railway engine compartment 114 contains a drive engine that allows propulsion of the chassis 102 along the rails. The engine in the engine compartment 114 also powers the hydraulics of the rail/plate clamp assemblies 110 and 112. As may be seen in FIG. 1A, the tie changing machine 100 is propelled on the wheels 104 and 106 by the drive engine on railroad tracks to the locations where ties need replacement. Of course, the tie changing machine 100 may also be towed to the desired location and therefore may not require the drive engine.

The tie changing machine 100 also includes an operator cabin 120 and engine housing 122. The engine housing 122 includes an engine, which powers the hydraulic systems of the tie changing components of tie changing machine 100 as explained below. The engine housing 122 and operator cabin 120 are mounted on a rotatable platform 124, which is mounted on a base 126 that is mounted on the chassis 102.

As may be seen in FIGS. 1B and 1C, the rotatable platform 124 may be swiveled to an operational position when the tie changing machine 100 operates to replace ties on the track. The dual rail/plate clamp assemblies 110 and 112 perform the functions of jacking up rails at the position that a tie should be replaced. The rail/plate clamp assemblies 110 and 112 also include plate clamps used to clamp the tie plates supporting both rails once they are detached from the ties and spread the front and rear anchors on both of the rails as will be explained below. This process frees the tie from the tie plates and the anchors and allows the tie to be moved out from under the rails.

The tie changing machine 100 includes a kicker assembly 130 mounted on the engine housing 122 near one end of the rotatable platform 124 and a tie changing assembly 140 mounted on the opposite end of the rotatable platform 124. The kicker assembly 130 includes a swinging arm 132 that has one end rotatably attached to the bottom of the engine housing 122. The opposite end of the swinging arm 132 is attached to a cross member 134. The cross member 134 is substantially perpendicular to the swinging arm 132. The cross member 134 has one end that includes a contact plate 136 that has a surface area approximately the size of the end of a cross tie. The kicker assembly 130 includes a stabilization plate 138 that joins the cross member 134 to the swinging arm 132.

The kicker assembly 130 is hydraulically propelled between an up position where the swinging arm 132 is rotated to a position roughly parallel to the chassis 102 as shown in FIG. 1B. When the rotating platform 124 is swiveled to the operational position shown in FIG. 1C, the swinging arm 132 may be rotated from the up position to a down position perpendicular to the chassis 102. As will be explained below, the swinging motion by the arm 132 propels a tie in the direction toward the tie changing assembly 140.

The tie changing assembly 140 includes a mounting plate 142, which is attached to the top of the rotating platform 124. The mounting plate 142 includes two support walls 144 and 146 that support the rotation of one end of a boom 148. The boom 148 is articulated and has a first end 150 that is pivotably mounted to the support walls 144 and 146. The first end 150 is part of a main support 152, which is attached to an articulated secondary support 154. The boom 148 includes parallel supports 156 and 158.

An opposite end 160 of the boom 148 supports a gripping arm 162, which is pivotably mounted on an axis 164 supported by the opposite end 160 of the secondary support 154. The gripping arm 162 includes two parallel supports that pivot around the axis 164.

An end 170 of the gripping arm 162 mounts a tie gripping assembly 180. The tie gripping assembly 180 includes two clamp arms 182 and 184, which clamp onto opposite sides of a railroad cross tie 186 as shown in FIGS. 1B and 1C.

Figure 2:
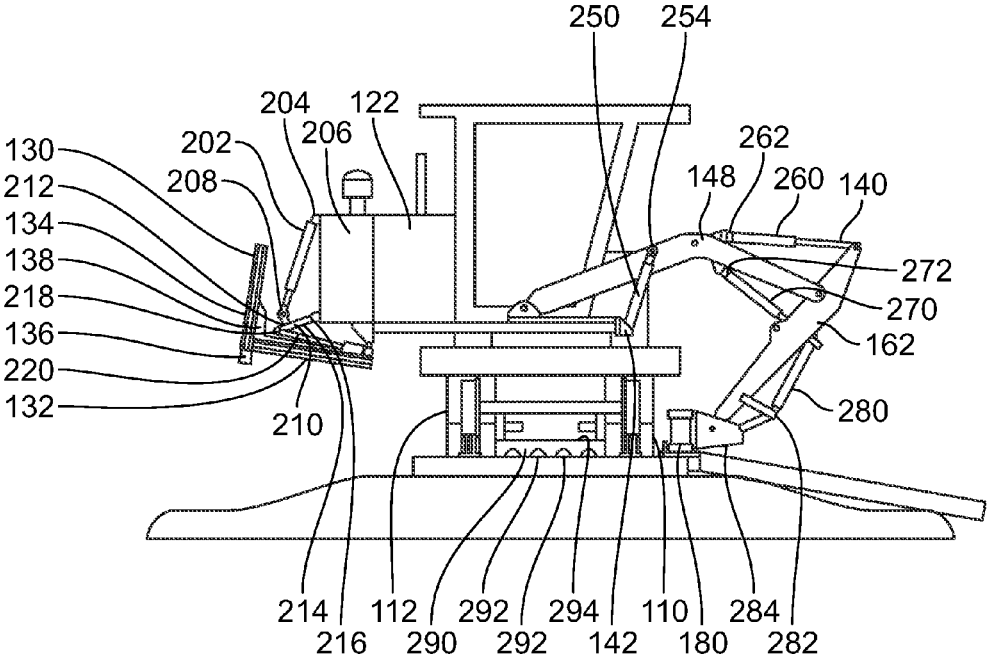
FIG. 2 is a cross-section view of the tie changing machine in FIG. 1A showing detailed actuation components.

FIG. 2 is a cross section of the tie changing machine 100 showing the hydraulic actuation system and additional operational components. The hydraulic actuation system includes a pump powered by the engine located in the engine housing 122. Hydraulic fluid may be stored in the hydraulic fluid reservoir 116 shown in FIG. 1A. The hydraulic actuation system is controlled by the operator in the operator cab 120. The kicker assembly 130 is actuated by a main hydraulic cylinder 202. One end of the cylinder 202 is coupled to a pivot point 204, which is mounted on the upper part of a back wall 206 of the engine housing 122. The other end of the cylinder 202 is attached to a rotatable mounting point 208 on a translation linkage 210. The translation linkage 210 has a first arm 212, which is coupled to the rotatable mounting point 208. A central arm 214 is rotatably connected to a pivot point 216 that is mounted near the bottom of the back wall 206. A second arm 218 holds a pivot that is rotatably coupled to a linkage 220. The other end of the linkage 220 is pivotably coupled to the swinging arm 132 of the kicker assembly 130.

When the main cylinder 202 is retracted, it pulls the arm 212 and pivots the translation linkage 210 around the pivot point 216 in a clockwise direction. When the main cylinder 202 is extended, it propels the translation linkage 210 in a counter clockwise direction and pushes the linkage 222 to rotate the swinging arm 132 of the kicker assembly 130 down.

As will be explained below, the tie changing assembly 140 operates in a similar fashion as a construction excavator. The tie changing assembly 140 includes a pair of boom cylinders 250 that each have a first end pivotably coupled to the mounting plate 142. The second ends of the boom cylinders 250 are mounted on pivot point 254 on the main support 152 of the boom 148. A top arm cylinder 260 has a proximal end pivotably attached to a pivot point 262 on the top of the gripping arm 162. The opposite, distal end of the top arm cylinder 260 is pivotably attached to the end of the gripping arm 162. A bottom arm cylinder 270 has a proximal end pivotably attached to a link member 272 on the bottom of the boom 148. The opposite, distal end of the bottom arm cylinder 270 is attached to the middle of the gripping arm 162. The arm cylinders 260 and 270 work in concert to provide additional force to rotate the arm 162.

The boom cylinders 250 may be extended to raise the boom 148 and gripper assembly 180 and may be retracted to lower the boom 148 and the tie gripping assembly 180. The top cylinder 260 and bottom cylinder 270 work in a complementary fashion to rotate the griping arm 162 around the end of the boom 148. The gripping arm 162 may be rotated away from the chassis 102 by retracting the top arm cylinder 260 and extending the bottom arm cylinder 270, causing the gripping arm 162 to rotate around the end of the boom 148. The gripping arm 162 may be rotated toward the chassis 102 by extending the top arm cylinder 260 and retracting the bottom arm cylinder 270. This causes the end of the gripping arm 162 attached to the tie gripping assembly 180 to be brought near the rail and ties.

A gripper cylinder 280 is attached between the gripping arm 162 and a linkage 282. The linkage 282 pivots on the arm 162 and has a rotating member 284 attached to the gripping assembly 180. The gripper cylinder 280 allows the gripping assembly 180 to be tilted in relation to a tie.

A ballast broom and tie guide attachment 290 is installed at the bottom of the chassis 102 between the rail/plate clamp assemblies 110 and 112. The attachment 290 may be rotated into place so that a series of brooms 292 may contact the top of the ties and brush away stray ballast on the ties. A tie guide 294 assists in insuring that a new tie is inserted in proper alignment with the tie plates and the rails as will be explained below.

Figure 3A:
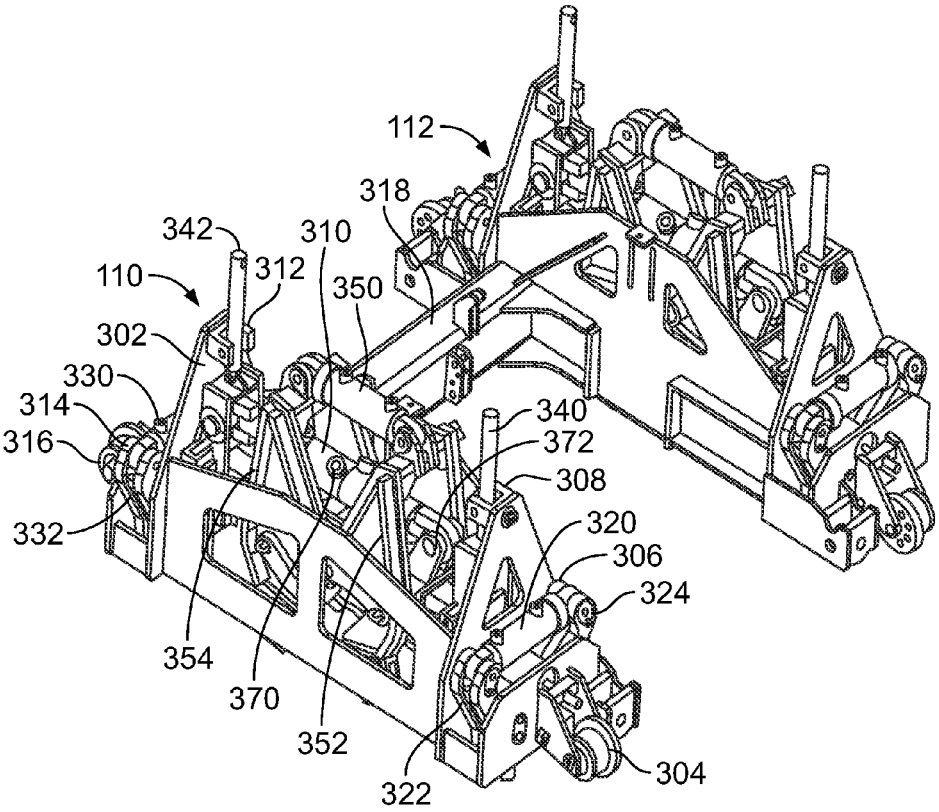
FIG. 3A is a close-up perspective view of the plate/rail gripping assemblies in the tie changing machine in FIG. 1.
Figure 3B:
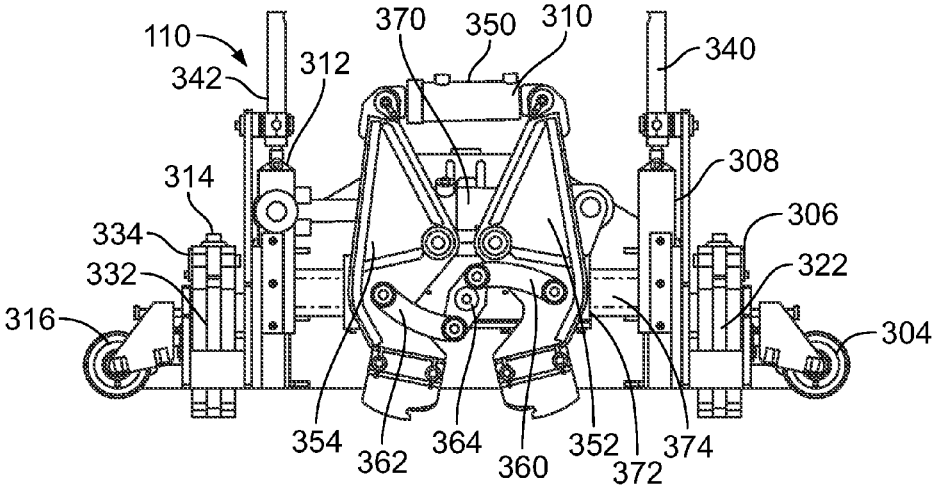
FIG. 3B is a side-view of one of the plate/rail gripping assemblies of the tie changing machine in FIG. 1.

FIG. 3A is a close-up perspective view of the rail/plate clamp assemblies 110 and 112 of the machine 100 in FIG. 1. FIG. 3B is a side view of components of the rail/plate clamp assembly 110 of the machine in FIG. 1. The rail/plate clamp assemblies 110 and 112 hold the plates from a tie, spread the anchors, and clamp onto the rails to jack up the rails so the tie changing assembly 140 may remove the tie. As shown in FIG. 3A, the rail/plate clamp assembly 110 includes a support frame 302. The support frame 302 is not shown in FIG. 3B to better show the rest of the components. The support frame 302 holds a front guide wheel 304, a front track gripping assembly 306, a front jack assembly 308, a tie plate gripping assembly 310, a rear jack assembly 312, a rear track gripping assembly 314 and a rear guide wheel 316. The other track jacking assembly 112 includes similar components. The front guide wheel 304 and the rear guide wheel 316 rotate on the track to provide additional stability.

The support frame 302 is coupled to the corresponding support frame of the rail/plate clamping assembly 112 by a cross frame bar 318. The front track gripping assembly 306 includes a cylinder 320 that powers a pair of articulating clamp arms 322 and 324 that grip the rail on one side of the tie. The rear track gripping assembly 306 includes a cylinder 330 that powers a pair of articulating clamp arms 332 and 334 that grip the rail on the opposite side of the tie. Once the clamp arms 322 and 324 and 332 and 334 grip the rails, hydraulic jacks at the bottom of the chassis 102 activate to lift the frame 302 and the rails that are held by the clamp arms 332 and 324.

The tie plate gripping assembly 310 includes a horizontal cylinder 350 that allows actuation and rotation of two grip arms 352 and 354. The grip arms 352 and 354 are attached to one end of a respective two curved pivot bars 360 and 362. The other end of the pivot bars 360 and 362 are rotatably attached to a rotating cam 364 to join the actions of the arms 352 and 354. When the horizontal cylinder 350 is extended, the grip arm 354 is moved in a counter-clockwise direction and through the pivot bars 360 and 362 rotates the other grip arm 352 in a clockwise direction. This action closes the grip arms 352 and 354 to grip the tie plate. When cylinder 350 is retracted, the grip arms 352 and 354 move apart and release the tie plate.

A lateral cylinder 370 allows the spreading of anchors on the tie. The cylinder 370 in this example is a dual cylinder arrangement that moves a sliding frame 372 forward and backward on a lateral track 374. The tie plate gripping assembly 310 is mounted on the sliding frame 372. Either end of the cylinder 370 may be extended. When both ends of the cylinder 350 are extended, the plate gripping assembly 310 moves to the forward position, sliding a front anchor away from the tie via the tie plate held by the grip arms 352 and 354. When both ends of the cylinder 370 are retracted, the plate clamp assembly 310 moves to the rear position, sliding the rear anchor away from the tie via the tie plate held by the grip arms 352 and 354. A pair of vertical cylinders 340 and 342 are retracted in order to move the plate gripped by the grip arms 352 and 354 up and hold it over the tie to be replaced. When the vertical cylinders 340 and 342 are extended, the plate is moved back to rest on the new tie.

Figure 4:
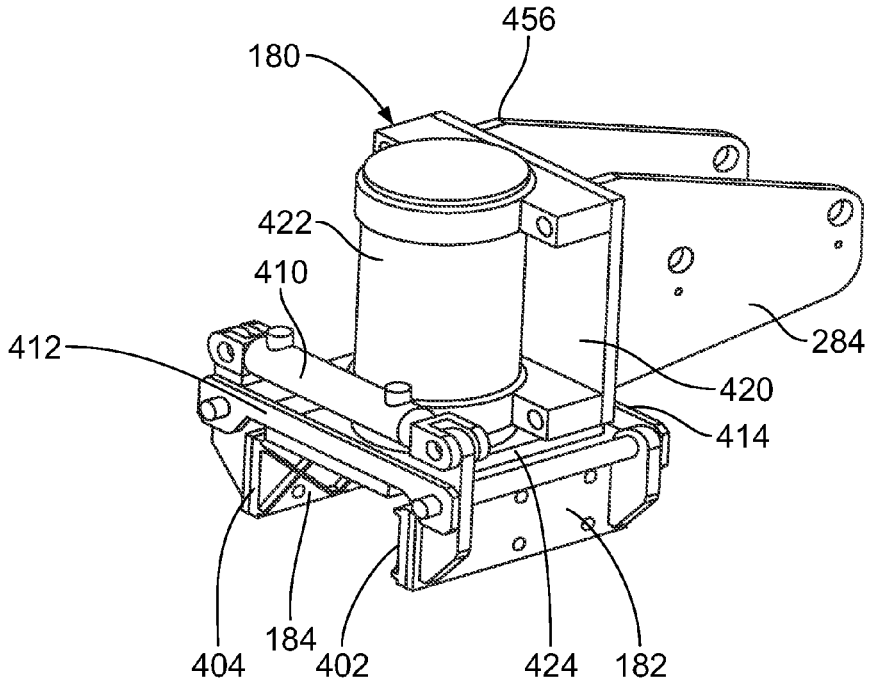
FIG. 4 is a perspective view of the tie gripping assembly of the tie changing machine in FIG. 1.

FIG. 4 is a close-up perspective view of an example tie gripping assembly 180 of the machine 100 in FIG. 1. The tie gripping assembly 180 includes the two clamp arms 182 and 184. The clamp arms 182 and 184 each have a respective contact plate 402 and 404 that contact the sides of the tie. The clamp arms 182 and 184 are rotatably attached to a clamp cylinder 410. The clamp arms 182 and 184 rotate on pivots attached to the ends of a front horizontal frame member 412 and a rear horizontal frame member 414. The rotating member 284 is attached to the arm 162 as shown in FIG. 2. The rotating member 284 includes a support plate 420 that supports a rotary actuator 422. The bottom of the rotary actuator 422 is attached to a grip support plate 424 that is attached to the horizontal members 412 and 414. The rotary actuator 422 rotates the grip support plate 424 and therefore the clamp arms 182 and 184. This rotation gives the tie gripping assembly 180 one additional degree of freedom. As explained above, the clamp arms 182 and 184 may be tilted by actuating the gripper cylinder 280 in FIG. 2 that rotates the rotating member 284 and therefore moves a gripped tie toward or away from the rails. The actuator 424 may be rotated to position a gripped tie more accurately side to side in relation to the rails.

Figure 5A:
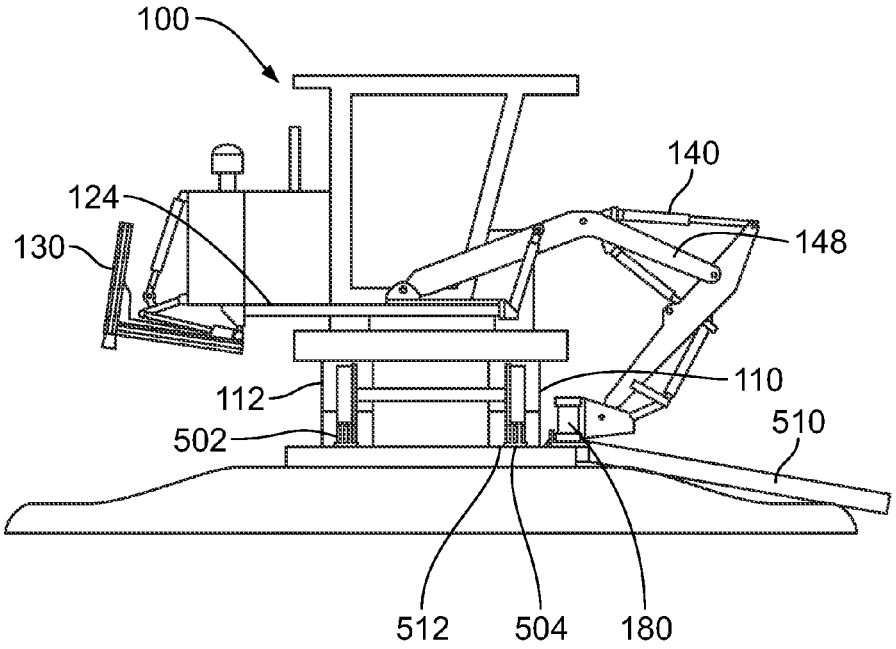
FIG. 5A-5E is a sequence showing the process of removal of a railroad tie using the tie changing machine shown in FIGS. 1A-1C.

FIGS. 5A-5E and 6A-6C are side and perspective views of the tie changing machine 100 operating to replace a railroad tie. The tie changing machine 100 is driven into position on rails 502 and 504 to the location on the track where the tie is to be replaced. As in normal operation, fresh ties such as a new tie 510 are dropped to the side of the approximate location of the tie to be replaced. A spike puller is used to pull the spikes out of the tie plates holding the rails 502 and 504 to an old tie 512. The platform 124 is rotated so the kicker assembly 130 and tie changing assembly 140 are parallel to the ties as shown in FIG. 5A. The kicker assembly 130 is initially in the up position. The tie changing assembly 140 swings the boom 148 down in proximity to one end of the tie 512. The tie changing assembly 140 engages the old tie 512 but does not engage the clamp arms 182 and 184 of the tie gripping assembly 180 on the tie 512. The plate clamp assembly 310 for each of the rail/plate clamp assemblies 110 and 112 actuate the gripping arms 352 and 354 to engage the tie plates on both ends of the old tie 512 and hold them in place. The plate is lifted by the tie plate gripping assembly 310 to be clear of the old tie 512. The anchors are spread from the old tie 512 by the forward and rear actuation of the cylinder 350 in FIG. 3. The rail clamps 322 and 324 and 332 and 334 of the rail/plate clamp assemblies 110 and 112 in FIGS. 3A-3B engage the rails 502 and 504. The hydraulic jacks extend and raise the rails 502 and 504 up at the location of the old tie 512 to relieve pressure on the tie 512 to be pulled.

Figure 5B:
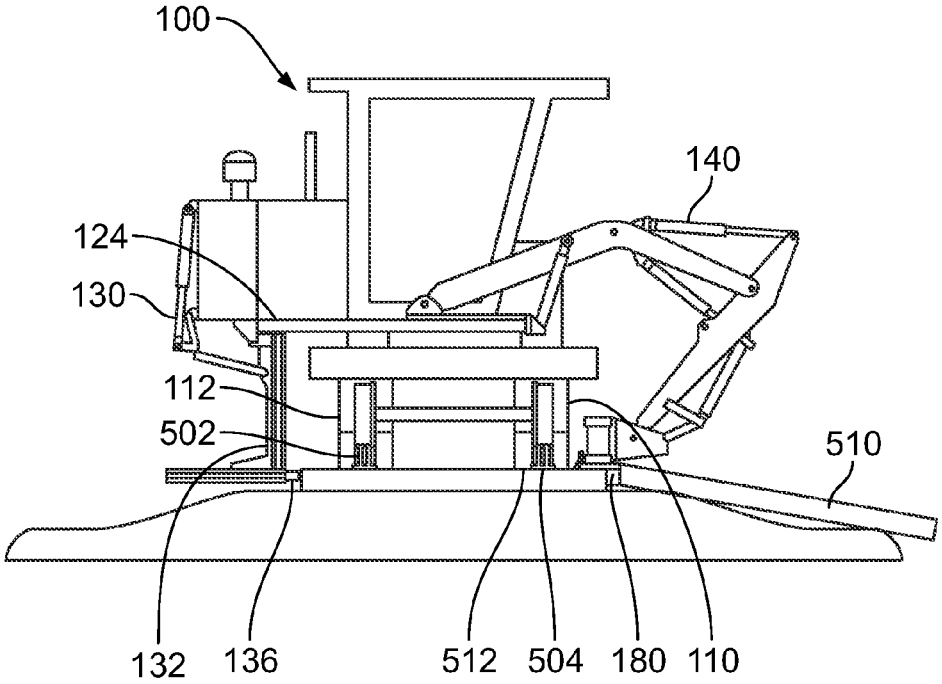
Figure 5C:
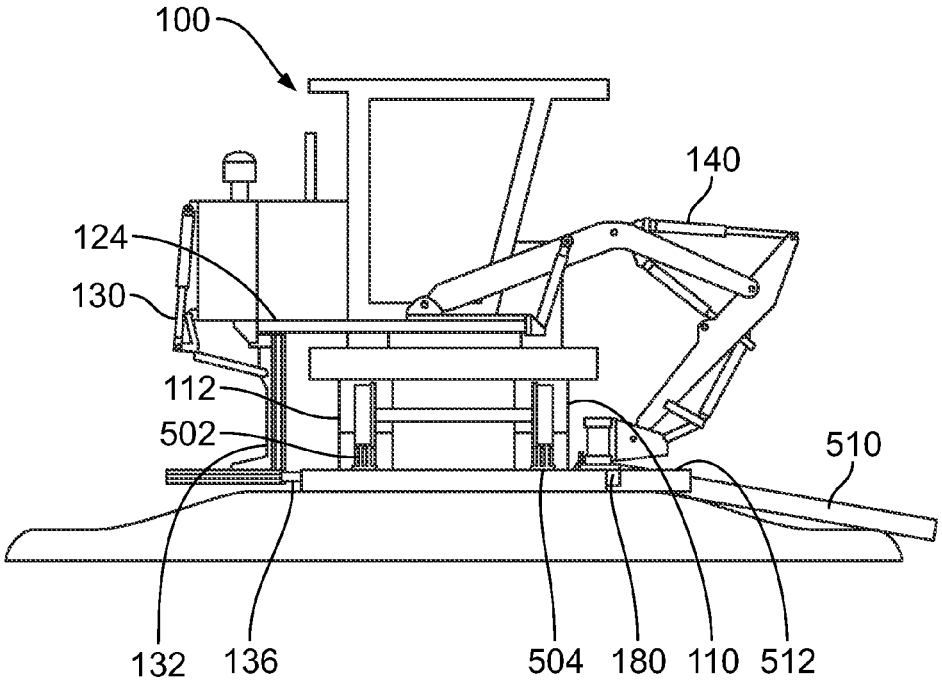

As shown in FIG. 5B, the kicker assembly 130 is activated and the swinging motion of the swinging arm 132 causes the contact plate 136 to hit the opposite end of the old tie 512 from the tie gripping assembly 180. The old tie 512 is thus moved toward the tie gripping assembly 180 as shown in FIG. 5C. The plates are held in place by the rail/plate clamp assemblies 110 and 112, and the tie 512 may move because the rails 502 and 504 have been jacked up. The clamp arms 182 and 184 of the tie gripping assembly 180 then clamp on to the old tie 512.

Figure 5D:
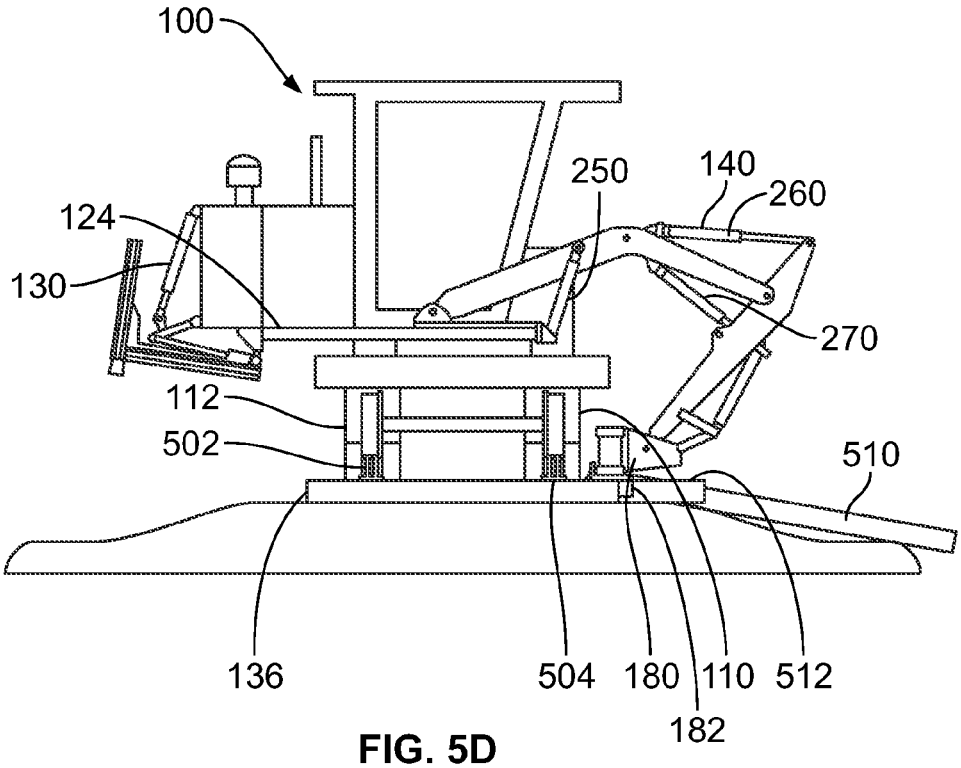
Figure 5E:
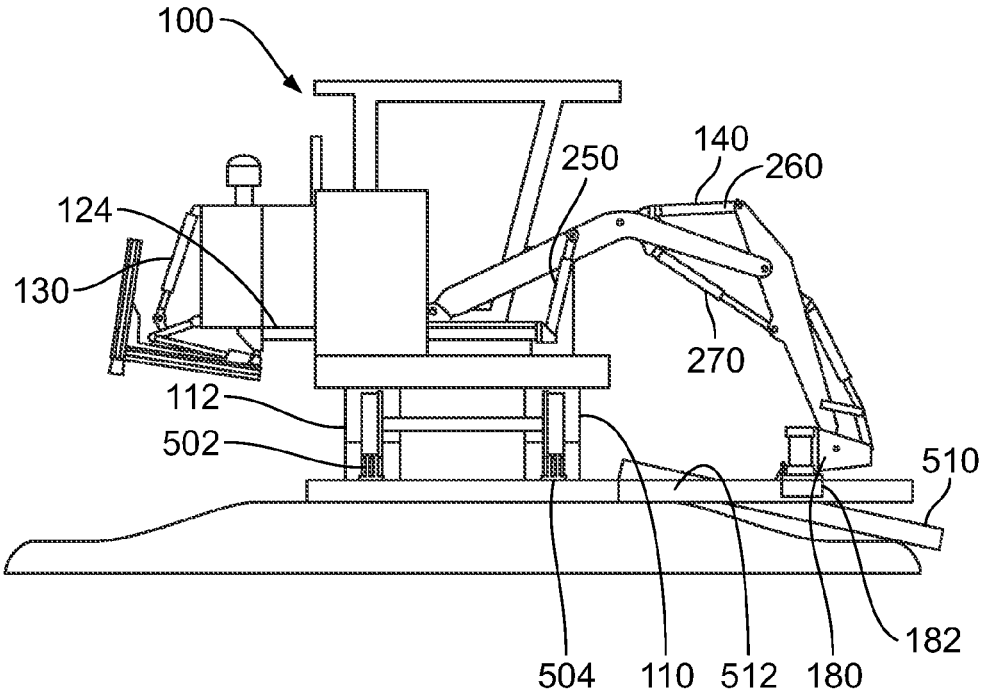
Figure 6A:
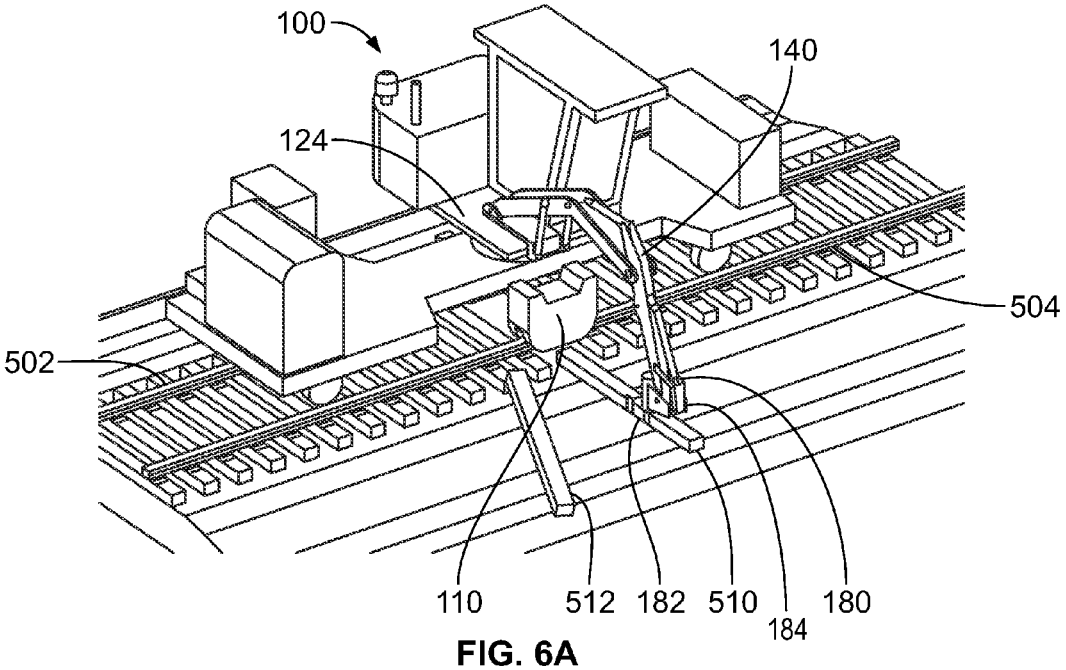
FIG. 6A-6B are perspective views of the tie changing machine shown in FIGS. 1A-1C inserting a new railroad tie.

As shown in FIG. 5D, the kicker assembly 130 is then moved to the up position and clear of the tie location. The tie gripping assembly 180 is moved outward by the combined movement of the boom cylinders 250 and the arm cylinders 260 and 270 to extract the old tie 512 that is gripped by the tie gripping assembly 180. As shown in FIG. 5E and FIG. 6A, once the old tie 512 is extracted from under the rails 502 and 504, it is released by the tie gripping assembly 180 and discarded. The tie changing assembly 140 is moved over the new tie 510 and the clamp arms 182 and 184 of the tie gripping assembly 180 grip one end of the new tie 510. The tie changing assembly 140 then aligns the new tie 510 with the open crib vacated by the old tie 512 by rotating the actuator 422.

Figure 6B:
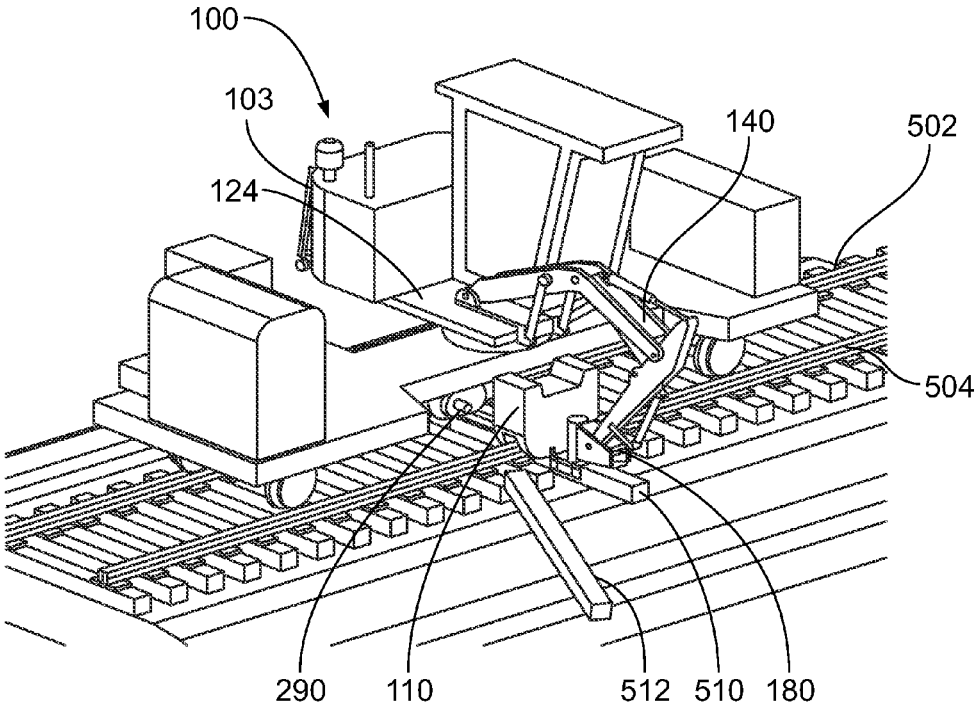

The tie guide and the ballast broom assembly 290 are moved down to align with the bottom of the tie plates as shown in FIG. 6B. The ballast broom assembly 290 sweeps any stray ballast from the top of the ties. The tie changing assembly 140 retracts to insert the new tie 510 as shown in FIG. 6A-6B. The kicker assembly 130 swings down the swinging arm 132 to provide an end stop in the form of the contact plate 136. As shown in FIG. 6B, the tie changing assembly 140 grips the new tie 510 and inserts it to the desired lateral position relative to the rails 502 and 504. Although the above figures show the insertion of ties from one side of the tracks 502 and 504, it is to be understood that the operation may be performed from the opposite side by rotating the platform 124 so the tie changing assembly 140 is placed over the opposite side of the track.

Once the new tie 510 is inserted in the desired position, the tie guide and ballast broom assembly 290 retract. The kicker assembly 130 is retracted to the up position. The jacks are retracted and the rail clamp arms 322 and 324 and 332 and 334 release the grip on the rails 502 and 504. The rail/plate clamp assemblies 110 and 112 release and retract and thus the plates are placed in position on the new tie 510. The boom 148 lifts into the clear. The machine 100 is then driven to the next tie to be replaced. The tie gang workers may thus reattach the plates to the new tie 510 by inserting spikes via a spiker machine.

The complete automation of the tie replacement process provides savings in labor that was previously required to retrieve the tie plates manually, place tie plates manually, and operate various specialized machines. The integrated tie changing machine 100 also saves the previous need for separate machines for removing the tie, spreading anchors, handling ties, and inserting tie plates. The concept of using the top half of a machine similar to an excavator mounted to the rail-bound chassis 102 has several benefits. By using excavator parts that are proven and mass-produced, the expectation is that the machine as a whole can be simpler, less costly to build, and easier to maintain. The combined plate-holding tie remover/inserter functions of the tie changing machine 100 have the benefit of eliminating several machines and manual laborers from a typical tie gang. Tie removal and insertion are done by the same machine as opposed to separate machines in a typical gang. By holding the plates, the machine 100 eliminates the manual labor involved with collecting plates and placing plates, as well as eliminating conventional plate inserter machine(s). By using the plate clamps to spread the anchors, the anchor spreaders used in a typical tie gang are eliminated. With greater flexibility to grab the new sleeper, the tie crane that typically operates between the remover and inserters is eliminated.

Each of these embodiments and obvious variations thereof is contemplated as falling within the spirit and scope of the claimed invention, which is set forth in the following claims.

What is claimed is:

1. A railroad tie changing machine, comprising:

a plurality of wheels operable to travel over rails;

a tie changing boom including a gripping assembly operable to clamp a railroad tie extending laterally under the rails, the tie changing boom being operable to move between a proximate position and a distal position relative to a side of the rails to grip a tie and remove it from under the rails;

a kicker operable to contact an end of the tie to move the tie toward the tie changing boom;

a rotatable platform coupled to the tie changing boom and the kicker and operable to rotate between a first position and a second position, wherein in the first position, the tie changing boom is disposed at a first side of the wheels and the kicker is disposed at a second side of the wheels, and in the second position, the tie changing boom is disposed at the second side of the wheels and the kicker is disposed at the first side of the wheels;

at least one jack operable to lift the rails at a location proximate to the tie; and a set of tie plate clamps operable to hold tie plates in place when the kicker moves the tie.

2. The railroad tie changing machine of claim 1, further comprising a self-propelled railroad chassis that includes the wheels.

3. The railroad tie changing machine of claim 2, wherein the rotatable platform is operable to rotate between a storage position in which the tie changing boom is perpendicular to an axle of the wheels and an active position in which the tie changing boom is parallel to an axle of the wheels.

4. The railroad tie changing machine of claim 1, wherein the tie changing boom and the kicker are hydraulically actuated.

5. The railroad tie changing machine of claim 1, wherein the tie changing boom includes a gripping arm, a first actuator coupled to a first pivot point, and a second actuator coupled to a second pivot point, the first and second pivot points being coupled to a same linkage.

6. The railroad tie changing machine of claim 1, wherein the gripping assembly includes a pair of clamp arms operable to grip the tie.

7. The railroad tie changing machine of claim 6, wherein the gripping assembly includes a rotatable actuator operable to rotate the pair of clamp arms.

8. The railroad tie changing machine of claim 1, wherein each of the tie plate clamps are coupled to a respective sliding frame operable to move the tie plate to loosen tie anchors attached to the tie.

9. The railroad tie changing machine of claim 8, further comprising an actuator operable to move the sliding frame in a reciprocating motion to thereby loosen the tie anchors.

10. A method of replacing a railroad tie, comprising:

clamping tie plates disposed under rails with a tie plate clamping assembly;

lifting the rails;

pushing a first end of a first tie disposed under the rails using a kicker coupled to a rotatable platform;

gripping a second end of the first tie using a tie gripper;

removing the first tie from under the rails using a boom arm coupled to the tie gripper and the rotatable platform;

gripping a first end of a second tie using the tie gripper;

positioning the second tie under the rails using the boom arm; and rotating the rotatable platform from a first position to a second position, wherein in the first position, the boom arm is disposed at a first side of the rails and the kicker is disposed at a second side of the rails, and in the second position, the boom arm is disposed at the second side of the rails and the kicker is disposed at the first side of the rails.

11. The method of claim 10, further comprising travelling over the rails to a location in proximity to the first tie.

12. The method of claim 10, further comprising rotating the rotatable platform between a storage position in which the boom arm is parallel to the rails and an active position in which the boom arm is perpendicular to the rails.

13. The method of claim 10, wherein the boom arm and the kicker assembly are hydraulically actuated.

14. The method of claim 10, wherein the boom arm includes a first actuator coupled to a first pivot point, and a second actuator coupled to a second pivot point, the first and second pivot points being coupled to a same linkage.

15. The method of claim 10, wherein the tie gripper includes a pair of clamp arms operable to grip a tie.

16. The method of claim 15, further comprising rotating the clamp arms using a rotatable actuator.

17. The method of claim 15, further comprising moving the tie plate clamping assembly from side to side to loosen tie anchors on the old railroad of the first tie.

* * * * *